US007199192B2

(12) United States Patent
Kennedy, III et al.

(10) Patent No.: US 7,199,192 B2
(45) Date of Patent: Apr. 3, 2007

(54) GOLF BALL

(75) Inventors: Thomas J. Kennedy, III, Wilbraham, MA (US); Mark L. Binette, Ludlow, MA (US)

(73) Assignee: Callaway Golf Company, Carlsbad, CA (US)

( * ) Notice: Subject to any disclaimer, the term of this patent is extended or adjusted under 35 U.S.C. 154(b) by 318 days.

(21) Appl. No.: 11/019,755

(22) Filed: Dec. 21, 2004

(65) Prior Publication Data

US 2006/0135287 A1 Jun. 22, 2006

(51) Int. Cl.
*A63B 37/06* (2006.01)
*A63B 37/00* (2006.01)
*C08L 9/00* (2006.01)

(52) U.S. Cl. ..... 525/263; 525/261; 525/274; 525/297; 525/315; 473/371; 473/372

(58) Field of Classification Search ..... None
See application file for complete search history.

(56) References Cited

U.S. PATENT DOCUMENTS 2,623,906 A 12/1952 Gresham
2,663,735 A 12/1953 Filar et al.
2,693,348 A 11/1954 Ellermann
2,791,572 A 5/1957 Doak
2,860,116 A 11/1958 Pikl
2,891,926 A 6/1959 Doak
2,895,950 A 7/1959 Krieble
3,026,358 A 3/1962 Lojewski
3,203,941 A 8/1965 Krieble
3,248,432 A 4/1966 Riley et al.
3,285,948 A 11/1966 Butter
3,378,510 A 4/1968 Wheat
3,387,043 A 6/1968 Kuraishi et al.
3,421,766 A 1/1969 Chmiel et al.
3,432,165 A 3/1969 Haines et al.
3,478,132 A 11/1969 Randolph
3,554,960 A 1/1971 Cluff
3,572,721 A 3/1971 Harrison et al.
3,658,624 A 4/1972 Lees
3,664,789 A 5/1972 Gibney
3,671,477 A 6/1972 Nesbitt
3,672,942 A 6/1972 Newmann
3,775,385 A 11/1973 Oxono et al.
3,808,006 A 4/1974 Smith
3,839,250 A 10/1974 Ehrend et al.
3,883,145 A 5/1975 Cox et al.
3,928,477 A 12/1975 Field et al.
3,944,604 A 3/1976 Hershman et al.
3,949,125 A 4/1976 Roberts
3,957,561 A 5/1976 Skoultchi
3,957,737 A 5/1976 Pautrat et al.
3,980,627 A 9/1976 McDowell et al.
3,981,342 A 9/1976 Farber et al.
3,984,487 A 10/1976 Watts et al.
3,987,037 A 10/1976 Bonham et al.
3,992,014 A 11/1976 Retford
4,010,129 A 3/1977 Aron
4,026,955 A 5/1977 Breaux et al.
4,052,244 A 10/1977 Skoultchi
4,057,590 A 11/1977 Gay
4,058,400 A 11/1977 Crivello
4,058,401 A 11/1977 Crivello
4,060,368 A 11/1977 Theysohn
4,064,922 A 12/1977 Farber et al.
4,065,537 A 12/1977 Miller et al.
4,069,054 A 1/1978 Smith
4,069,055 A 1/1978 Crivello
4,069,056 A 1/1978 Crivello
4,075,250 A 2/1978 Field et al.
4,076,255 A 2/1978 Moore
4,081,308 A 3/1978 Skoultchi
4,082,288 A 4/1978 Martin et al.
4,102,687 A 7/1978 Crivello
4,104,205 A 8/1978 Novotny et al.
4,108,747 A 8/1978 Crivello
4,111,897 A 9/1978 Black
4,127,373 A 11/1978 Anders et al.
4,129,538 A 12/1978 Kaplan et al.
4,130,535 A 12/1978 Coran et al.
4,133,963 A 1/1979 Holmes
4,133,966 A 1/1979 Pretzer et al.
4,138,438 A 2/1979 Gay
4,139,385 A 2/1979 Crivello
4,147,732 A 4/1979 Mendiratta
4,168,391 A 9/1979 Slinkard et al.
4,171,461 A 10/1979 Bartish
4,181,635 A 1/1980 Takamatsu et al.
4,210,606 A 7/1980 Austin et al.
4,216,288 A 8/1980 Crivello
4,262,154 A 4/1981 Gane et al.
4,264,075 A 4/1981 Miller et al.
4,266,772 A 5/1981 Martin et al.
4,305,851 A 12/1981 Tominaga et al.
4,322,202 A 3/1982 Martinez
4,328,133 A 5/1982 Ogawa et al.
4,341,667 A 7/1982 Lal et al.
4,426,419 A 1/1984 Uffner et al.
4,426,459 A 1/1984 Watabe et al.
4,440,816 A 4/1984 Uffner
4,447,557 A 5/1984 Pretzer et al.

(Continued)

OTHER PUBLICATIONS

Pine, Organic Chemistry 4th Edition, p. 39-40.*

*Primary Examiner*—David J. Buttner
(74) *Attorney, Agent, or Firm*—Michael A. Catania; Elaine H. Lo

(57) ABSTRACT

An elastomeric composition for forming a golf ball or a component thereof is disclosed that includes the use of a non-conjugated diene monomer having two or more vinyl ($CH_2$═CH—) terminal end groups. The composition produces a molded product exhibiting an enhanced combination of increased compression (i.e., softness) and resilience (C.O.R.).

25 Claims, No Drawings

U.S. PATENT DOCUMENTS 4,454,362 A 6/1984 Dietrich et al.
4,471,094 A 9/1984 Uffner et al.
4,478,912 A 10/1984 Uffner et al.
4,481,335 A 11/1984 Stark
4,483,537 A 11/1984 Hanada et al.
4,544,675 A 10/1985 Anderson, Jr.
4,546,980 A 10/1985 Gendreau et al.
4,561,657 A 12/1985 Tominaga et al.
4,564,670 A 1/1986 Kearnan
4,579,871 A 4/1986 Linden et al.
4,600,745 A 7/1986 Creighton
4,683,257 A 7/1987 Kakiuchi et al.
4,696,475 A 9/1987 Tomita et al.
4,721,749 A 1/1988 Odar
4,722,977 A 2/1988 Fischer
4,726,590 A 2/1988 Molitor
4,770,422 A 9/1988 Isaac
4,773,763 A 9/1988 Weber
4,824,512 A 4/1989 Kohlstadt
4,838,556 A 6/1989 Sullivan
4,844,471 A 7/1989 Terence et al.
4,852,884 A 8/1989 Sullivan
4,858,924 A 8/1989 Saito et al.
4,859,166 A 8/1989 Hamada et al.
4,929,678 A 5/1990 Hamada et al.
4,931,376 A 6/1990 Hattori et al.
4,955,613 A 9/1990 Gendreau et al.
4,955,966 A 9/1990 Yuki et al.
4,963,309 A 10/1990 Gohlisch et al.
4,974,852 A 12/1990 Hiraoka
4,984,803 A 1/1991 Llort et al.
4,986,545 A 1/1991 Sullivan
5,082,285 A 1/1992 Hamada et al.
5,098,105 A 3/1992 Sullivan
5,116,060 A 5/1992 Sullivan et al.
5,120,791 A 6/1992 Sullivan
5,131,662 A 7/1992 Pollitt
5,187,013 A 2/1993 Sullivan
5,209,485 A 5/1993 Nesbitt et al.
5,215,308 A 6/1993 Nesbitt
5,267,788 A 12/1993 Rockstedt
5,304,576 A 4/1994 Martinez
5,306,760 A 4/1994 Sullivan
5,312,857 A 5/1994 Sullivan
5,324,783 A 6/1994 Sullivan
5,328,959 A 7/1994 Sullivan
5,330,837 A 7/1994 Sullivan
5,338,610 A 8/1994 Sullivan
5,356,939 A 10/1994 Burrowes et al.
5,362,759 A 11/1994 Hunt et al.
5,387,637 A 2/1995 Sullivan
5,397,825 A 3/1995 Segrest
5,487,602 A 1/1996 Valsamis et al.
RE35,293 E 7/1996 Hiraoka et al.
5,542,677 A 8/1996 Sullivan et al.
5,548,045 A 8/1996 Goto
5,556,888 A 9/1996 Koda et al.
5,580,057 A 12/1996 Sullivan et al.
5,585,440 A 12/1996 Yamada et al.
5,591,803 A 1/1997 Sullivan et al.
5,656,680 A 8/1997 Aguirre et al.
5,688,191 A 11/1997 Cavallaro et al.
5,691,429 A 11/1997 Van Der Arend
5,703,166 A 12/1997 Rajagopalan et al.
5,711,723 A 1/1998 Hiraoka et al.
5,721,304 A 2/1998 Pasgua
5,730,664 A 3/1998 Asakura et al.
5,733,206 A 3/1998 Nesbitt et al.
5,759,676 A 6/1998 Cavallaro et al.
5,779,561 A 7/1998 Sullivan et al.
5,779,562 A 7/1998 Melvin et al.
5,783,293 A 7/1998 Lammi
5,803,831 A 9/1998 Sullivan et al.
5,810,678 A 9/1998 Cavallaro et al.
5,813,923 A 9/1998 Cavallaro et al.
5,824,746 A 10/1998 Harris et al.
5,830,087 A 11/1998 Sullivan et al.
5,833,553 A 11/1998 Sullivan et al.
5,836,831 A 11/1998 Stanton et al.
5,856,388 A 1/1999 Harris et al.
5,857,925 A 1/1999 Sullivan et al.
5,866,663 A 2/1999 Brookhart et al.
5,869,578 A 2/1999 Rajagopalan
5,873,796 A 2/1999 Cavallaro et al.
5,880,241 A 3/1999 Brookhart et al.
5,882,567 A 3/1999 Cavallaro et al.
5,885,172 A 3/1999 Herbert
5,886,224 A 3/1999 Brookhart et al.
5,891,963 A 4/1999 Brookhart et al.
5,891,973 A 4/1999 Sullivan et al.
5,902,855 A 5/1999 Sullivan
5,905,125 A 5/1999 Tsujimoto
5,916,989 A 6/1999 Brookhart, III et al.
5,922,252 A 7/1999 Stanton et al.
5,971,870 A 10/1999 Sullivan et al.
5,971,872 A 10/1999 Sullivan et al.
5,976,443 A 11/1999 Nesbitt et al.
5,984,806 A 11/1999 Sullivan et al.
5,998,506 A 12/1999 Nesbitt
6,015,356 A 1/2000 Sullivan et al.
6,018,003 A 1/2000 Sullivan et al.
6,152,835 A 11/2000 Sullivan et al.
6,258,302 B1 7/2001 Nesbitt
6,277,920 B1 8/2001 Nesbitt
6,422,953 B1 7/2002 Nesbitt et al.
6,425,833 B1 7/2002 Sullivan
2003/0114249 A1* 6/2003 Voorheis et al. ..... 473/367
2005/0054746 A1* 3/2005 Nesbitt et al. ..... 522/142

* cited by examiner

GOLF BALL

The present disclosure relates, in various embodiments, to elastomeric compositions for producing golf balls or molded components thereof. The golf balls and/or components exhibit enhanced combinations of compression and resilience properties. Methods of preparing such golf balls and/or components are also disclosed herein.

BACKGROUND

For many years, golf balls have been categorized into three different groups. These groups are, namely, one-piece or unitary balls, wound balls, and multi-piece solid balls.

A one-piece ball typically is formed from a solid mass of moldable material, such as an elastomer, which has been cured to develop the necessary degree of hardness, durability, etc., desired. The one-piece ball generally possesses the same overall composition between the interior and exterior of the ball. One piece balls are described, for example, in U.S. Pat. No. 3,313,545; U.S. Pat. No. 3,373,123; and U.S. Pat. No. 3,384,612.

A wound ball has frequently been referred to as a "three-piece ball" since it is produced by winding vulcanized rubber thread under tension around a solid or semi-solid center to form a wound core. The wound core is then enclosed in a single or multi-layer covering of tough protective material. Until relatively recently, the wound ball was desired by many skilled, low handicap golfers due to a number of characteristics.

For example, the three-piece wound ball was previously produced utilizing a balata, or balata like, cover which is relatively soft and flexible. Upon impact, it compresses against the surface of the club producing high spin. Consequently, the soft and flexible balata covers along with wound cores provide an experienced golfer with the ability to apply a spin to control the ball in flight in order to produce a draw or a fade or a backspin which causes the ball to "bite" or stop abruptly on contact with the green. Moreover, the balata cover produces a soft "feel" to the low handicap player. Such playability properties of workability, feel, etc., are particularly important in short iron play and low swing speeds and are exploited significantly by highly skilled players.

However, a three-piece wound ball has several disadvantages both from a manufacturing standpoint and a playability standpoint. In this regard, a thread wound ball is relatively difficult to manufacture due to the number of production steps required and the careful control which must be exercised in each stage of manufacture to achieve suitable roundness, velocity, rebound, "click", "feel", and the like.

Additionally, a soft thread wound (three-piece) ball is not well suited for use by the less skilled and/or high handicap golfer who cannot intentionally control the spin of the ball. For example, the unintentional application of side spin by a less skilled golfer produces hooking or slicing. The side spin reduces the golfer's control over the ball as well as reduces travel distance.

Similarly, despite all of the benefits of balata, balata covered balls are easily "cut" and/or damaged if mishit. Consequently, golf balls produced with balata or balata containing cover compositions can exhibit a relatively short life span. As a result of this negative property, balata and its synthetic substitute, trans-polyisoprene, and resin blends, have been essentially replaced as the cover materials of choice by golf ball manufacturers by materials comprising ionomeric resins and other elastomers such as polyurethanes.

Multi-piece solid golf balls, on the other hand, include a solid resilient core and a cover having single or multiple layers employing different types of material molded on the core. The core can also include one or more layers. Additionally, one or more intermediate layers can also be included between the core and cover layers.

By utilizing different types of materials and different construction combinations, multi-piece solid golf balls have now been designed to match and/or surpass the beneficial properties produced by three-piece wound balls. Additionally, the multi-piece solid golf balls do not possess the manufacturing difficulties, etc., that are associated with the three-piece wound balls.

The one-piece golf ball and the solid core for a multi-piece solid (non-wound) ball frequently are formed from a combination of elastomeric materials such as polybutadiene and other rubbers that are cross-linked. These materials are molded under high pressure and temperature to provide a ball or core of suitable compression and resilience. The cover or cover layers typically contain a substantial quantity of ionomeric resins that impart toughness and cut resistance to the covers. Additional cover materials include synthetic balatas, polyurethanes, and blends of ionomers with polyurethanes, etc.

As a result, a wide variety of multi-piece solid golf balls are now commercially available to suit an individual player's game. In essence, different types of balls have been, and are being, specifically designed to suit various skill levels. Moreover, improved golf balls are continually being produced by golf ball manufacturers with technological advancements in materials and manufacturing processes.

In this regard, the elastomeric composition of the core or center of a golf ball is important in that it affects several characteristics (i.e., playability, durability, etc.) of the ball. Additionally, the elastomeric composition provides resilience to the golf ball, while also providing many desirable properties to both the core and the overall golf ball, including weight, compression, etc.

Due to the continuous importance of improving the properties of a golf ball, it would be beneficial to form an elastomeric composition that exhibits improved properties, particularly improved combinations of compression and/or resilience, over known compositions. This is one of the objectives of the development disclosed herein.

This and other non-limiting objects and features of the development will be apparent from the following description and from the claims.

BRIEF DESCRIPTION

The present development satisfies the noted general objectives and provides, in one aspect, a polybutadiene rubber composition for producing a golf ball or a molded component thereof. The resulting golf ball or golf ball component exhibits an enhanced combination of compression and resilience. Methods for producing such a golf ball or golf ball component are also included herein.

And in yet another aspect, disclosed herein is a golf ball comprising a core component formed from a cured, polybutadiene rubber composition. One or more non-conjugated diene monomers having two or more vinyl ($CH_2{=}CH{-}$) terminal end groups are included in the composition to increase the combination of compression and resilience (i.e., C.O.R.) of the resulting molded product. The golf ball further comprises one or more core, intermediate or cover layers disposed over the core component.

In a further aspect, the present development provides a golf ball comprising a spherical molded rubber component formed from a polybutadiene, a mixture of polybutadienes or a mixture of polybutadiene with one or more other elastomers, and one or more curing agents. The curing agents include metallic salts of unsaturated carboxylic acid and a crosslinking initiator such as organic peroxide. The curing agents are blended into the polybutadiene rubber to crosslink the molecules main chain, etc. Also included in the composition is a non-conjugated diene monomer having two or more vinyl ($CH_2$═CH—) terminal end groups. The non-conjugated diene monomers comprise from about 5 to about 12 carbon groups, including from about 8 to about 12 carbon groups. This combination of materials produces, when molded, golf balls exhibiting improved combinations of characteristics, such as increased compression and/or resilience.

In an additional aspect, the development disclosed herein concerns a composition for forming a molded golf ball or a golf ball component such as a molded core. The composition comprises a base elastomer selected from polybutadiene, mixtures of polybutadiene or mixtures of polybutadiene and other elastomers, curing agents such as a metallic salt of an unsaturated carboxylic acid and a crosslinking initiator such as an organic peroxide, and a non-conjugated diene monomer having two or more vinyl ($CH_2$═CH—) terminal end groups. Preferably, the polybutadiene has a weight average molecular weight of about 50,000 to about 1,000,000 and the non-conjugated diene monomer is selected from the group consisting of 1,7-Octadiene; 1,9-Decadiene, and 1,2,4-Trivinyl cyclohexane. The composition can also include one or more modifying ingredients selected from the group consisting of fillers, fatty acids, peptizers, metal oxides, and mixtures thereof.

Further scope of the applicability of the present development will become apparent from the detailed description given hereafter. It should, however, be understood that the detailed description and specific examples, while indicating preferred embodiments of the disclosure, are given by way of illustration only, since various changes and modifications within the spirit and scope of the development will become apparent to those skilled in the art.

DETAILED DESCRIPTION OF THE PREFERRED EMBODIMENTS

The present disclosure relates to improved elastomeric compositions for producing a golf ball or to a molded golf ball component thereof, such as a molded core or center component utilized in golf ball construction.

It has been ascertained that the addition of a non-conjugated diene monomer having two or more vinyl ($CH_2$═CH—) terminal end groups to polybutadiene based elastomers produces molded golf ball components and/or golf ball products incorporating the same which exhibit enhanced combinations of compression and/or resilience.

The compositions of the present development comprise a polybutadiene-based elastomer selected from the group consisting of polybutadienes, mixtures thereof or mixtures of the polybutadienes with other elastomers, one or more crosslinking agents and a non-conjugated diene monomer having two or more vinyl ($CH_2$═CH—) terminal end groups. The non-conjugated diene monomers include, but are not limited to, 1,7-Octadiene, 1,9-Decadiene, and 1,2,4-Trivinyl cyclohexane. Also optionally included in the compositions are one or more modifying ingredients such as additional curing agents or aids, processing additives, secondary peptizers, fillers, reinforcing agents, fatty acids, metal oxides, etc. The polybutadiene preferably has a weight average molecular weight of about 50,000 to about 1,000,000, including from about 50,000 to about 500,000, and a Mooney viscosity of from about 20 to about 100. It has been found that the addition of the non-conjugated diene monomers to the polybutadiene compositions enhances the compression and/or resilience of the molded products.

The golf balls including the compositions of the present disclosure can be one-piece, two-piece, or multi-layer balls. Non-limiting examples of such golf balls include a one-piece ball comprising polybutadiene rubber. Alternatively, a two-piece ball can be formed with a core formed from a core composition including polybutadiene rubber of the present development and a cover disposed about the core. A multi-piece ball can also be formed with a core formed from a core composition including a polybutadiene rubber, a mantle or intermediate layer, and a cover disposed about the mantle. A multi-layer ball can also be formed wherein the ball includes a multi-layer core, where one or more layers of the multi-layer core is formed from a core composition including polybutadiene rubber in accordance with the present disclosure. Additionally, the compositions of this development can also be utilized to produce the inner center or molded core of a three-piece or wound ball.

In this regard, the construction of unitary golf balls or golf balls with molded polybutadiene cores or other components with higher resilience, while having substantially the same or lower compression, i.e., softness, is in many instances desired. When the construction of a molded core is desired, the diameter of the core is determined based upon the desired ball diameter minus the thickness of the cover layer(s) or intermediate layer(s) (if desired). The core generally has a diameter of about 1.0 to 1.6 inches, preferably about 1.40 to 1.60 inches, and more preferably from about 1.470 to about 1.575 inches. Additionally, the weight of the core is adjusted so that the finished golf ball closely approaches the U.S.G.A. upper weight limit of 1.620 ounces. The molded core exhibits a resilience (C.O.R.) of greater than 0.800, preferably greater than 0.805, and more preferably greater than 0.810, and a compression (Instron) of greater than 0.0880, preferably greater than 0.0900, and more preferably greater than 0.0950. Optimal combinations of core compression and resilience are further exhibited by this development.

A detailed description of the various components and materials utilized in the golf balls and/or components thereof of this disclosure is set forth in more detail below after a description of various golf ball properties and characteristics utilized herein.

Properties and Characteristics

Two principal properties involved in golf ball performance are resilience and compression. Resilience is determined by the coefficient of restitution (C.O.R.), i.e., the constant "e" which is the ratio of the relative velocity of an elastic sphere after direct impact to that before impact. As a result, the coefficient of restitution ("e") can vary from 0 to 1, with 1 being equivalent to a perfectly or completely elastic collision and 0 being equivalent to a perfectly or completely inelastic collision.

Resilience (C.O.R.), along with additional factors such as club head speed, angle of trajectory and ball configuration (i.e., dimple pattern) generally determine the distance a ball will travel when hit. Since club head speed and the angle of trajectory are factors not easily controllable by a manufacturer, factors of concern among manufacturers are the coefficient of restitution (C.O.R.) and the surface configuration of the ball.

The coefficient of restitution (C.O.R.) in solid core balls is a function of the composition of the molded core and of the cover. In balls containing a wound core (i.e., balls comprising a liquid or solid center, elastic windings, and a cover), the coefficient of restitution is a function of not only the composition of the center and the cover, but also the composition and tension of the elastomeric windings.

The coefficient of restitution is the ratio of the outgoing velocity to the incoming velocity. In the examples of this application, the coefficient of restitution of a golf ball was measured by propelling a ball horizontally at a speed of 125±1 feet per second (fps) against a generally vertical, hard, flat steel plate and measuring the ball's incoming and outgoing velocity electronically. Speeds were measured with a pair of Ohler Mark 55 ballistic screens, which provide a timing pulse when an object passes through them. The screens are separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it.

As indicated above, the incoming speed should be 125±1 fps. Furthermore, the correlation between C.O.R. and forward or incoming speed has been studied and a correction has been made over the ±1 fps range so that the C.O.R. is reported as if the ball had an incoming speed of exactly 125.0 fps.

The coefficient of restitution must be carefully controlled in all commercial golf balls if the ball is to be within the specifications regulated by the United States Golf Association (U.S.G.A.). Along this line, the U.S.G.A. standards indicate that a "regulation" ball cannot have an initial velocity (i.e., the speed off the club) exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

As indicated above, compression is another important property involved in the performance of a golf ball. The compression of the ball can affect the playability of the ball on striking and the sound or "click" produced. Similarly, compression can affect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influence the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect, the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, compression indicates the amount of change in golf ball's shape upon striking. The development of solid core technology in two-piece or multi-piece solid balls has allowed for much more precise control of compression in comparison to thread wound three-piece balls. This is because in the manufacture of solid core balls, the amount of deflection or deformation is precisely controlled by the chemical formula used in making the cores This differs from wound three-piece balls wherein compression is controlled in part by the winding process of the elastic thread. Thus, two-piece and multi-layer solid core balls exhibit much more consistent compression readings than balls having wound cores such as the thread wound three-piece balls.

In the past, PGA compression related to a scale of from 0 to 200 given to a golf ball. The lower PGA compression value, the softer the feel of the ball upon striking. In practice, tournament quality balls have compression ratings around 40 to 110, and preferably around 50 to 100.

In determining PGA compression using the 0 to 200 scale, a standard force is applied to the external surface of the ball. A ball which exhibits no deflection (0.0 inches in deflection) is rated 200 and a ball which deflects $^{2}/_{10}{}^{th}$ of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200 to 100) and a ball which deflects 0.110 inches (110×0.001 inches) has a PGA compression of 90 (i.e., 200 to 110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inches by means of a crank mechanism. In its open position, the gap between the anvils is 1.780 inches, allowing a clearance of 0.200 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches. When golf ball components (i.e., centers, cores, mantled core, etc.) smaller than 1.680 inches in diameter are utilized, metallic shims are included to produce the combined diameter of the shims and the component to be 1.680 inches.

An example to determine PGA compression can be shown by utilizing a golf ball compression tester produced by OK Automation, Sinking Spring, Pa. (formerly, Atti Engineering Corporation of Newark, N.J.). The compression tester produced by OK Automation is calibrated against a calibration spring provided by the manufacturer. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that is measures the upward movement of the spring-loaded anvil. The golf ball to be tested is placed in the lower platform, which is then raised a fixed distance. The upper portion of the golf ball comes in contact with and exerts a pressure on the spring-loaded anvil. Depending upon the distance of the golf ball to be compressed, the upper anvil is forced upward against the spring.

Alternative devices have also been employed to determine compression. For example, Applicant also utilizes a modified Riehle Compression Machine originally produced by Riehle Bros. Testing Machine Company, Philadelphia, Pa., to evaluate compression of the various components (i.e., cores, mantle cover balls, finished balls, etc.) of the golf balls. The Riehle compression device determines deformation in thousandths of an inch under a load designed to emulate the 200 pound spring constant of the Atti or PGA compression testers. Using such a device, a Riehle compression of 61 corresponds to a deflection under load of 0.061 inches.

Furthermore, additional compression devices may also be utilized to monitor golf ball compression. These devices have been designed, such as a Whitney Tester, Whitney Systems, Inc., Chelmsford, Mass., or an Instron Device, Instron Corporation, Canton, Mass., to correlate or correspond to PGA or Atti compression through a set relationship or formula.

As used herein, "Shore D hardness" of a cover is measured generally in accordance with ASTM D-2240, except the measurements are made on the curved surface of a molded cover, rather than on a plaque. Furthermore, the Shore D hardness of the cover is measured while the cover remains over the core. When a hardness measurement is made on a dimpled cover, Shore D hardness is measured at a land area of the dimpled cover.

A "Mooney unit" is an arbitrary unit used to measure the plasticity of raw, or unvulcanized rubber. The plasticity in Mooney units is equal to the torque, measured on an arbitrary scale, on a disk in a vessel that contains rubber at a temperature of 212° F. (100° C.) and that rotates at two revolutions per minute.

The measurement of Mooney viscosity, i.e. Mooney viscosity [$ML_{1+4}$(100° C.], is defined according to the standard ASTM D-1646, herein incorporated by reference. In ASTM D-1646, it is stated that the Mooney viscosity is not a true viscosity, but a measure of shearing torque over a range of shearing stresses. Measurement of Mooney viscosity is also described in the *Vanderbilt Rubber Handbook,* 13th Ed., (1990), pages 565–566, also herein incorporated by reference. Generally, polybutadiene rubbers have Mooney viscosities, measured at 212° F., of from about 25 to about 65. Instruments for measuring Mooney viscosities are commercially available such as a Monsanto Mooney Viscometer, Model MV 2000. Another commercially available device is a Mooney viscometer made by Shimadzu Seisakusho Ltd.

As will be understood by those skilled in the art, polymers may be characterized according to various definitions of molecular weight. The "number average molecular weight," $M_n$, is defined as:

$$M_n = \frac{\sum N_i / M_i}{\sum N_i}$$

where the limits on the summation are from i=1 to i=infinity where $N_i$ is the number of molecules having molecular weight $M_i$.

"Weight average molecular weight," $M_w$ is defined as:

$$M_w = \frac{\sum N_i M_i^2}{\sum N_i M_i}$$

where $N_i$ and $M_i$ have the same meanings as noted above.

The "Z-average molecular weight," $M_z$, is defined as:

$$M_z = \frac{\sum N_i M_i^{a+1}}{\sum N_i M_i^a}$$

where $N_i$ and $M_i$ have the same meanings as noted above and a=2. $M_z$ is a higher order molecular weight that gives an indication of the processing characteristics of a molten polymer.

"$M_{peak}$" is the molecular weight of the most common fraction or sample, i.e. having the greatest population.

Considering these various measures of molecular weight, provides an indication of the distribution or rather the "spread" of molecular weights of the polymer under review.

A common indicator of the degree of molecular weight distribution of a polymer is its "polydispersity", P:

$$P = \frac{M_w}{M_n}$$

Polydispersity, also referred to as "dispersity", also provides an indication of the extent to which the polymer chains share the same degree of polymerization. If the polydispersity is 1.0, then all polymer chains must have the same degree of polymerization. Since weight average molecular weight is always equal to or greater than the number average molecular weight, polydispersity, by definition, is equal to or greater than 1.0.

As used herein, the term "phr" refers to the number of parts by weight of a particular component in an elastomeric or rubber mixture, relative to 100 parts by weight of the total elastomeric or rubber mixture.

The Molded Elastomeric Component

The present development is directed to an elastomeric rubber composition for producing a molded sphere, such as a one-piece golf ball, a molded core for a multi-piece golf ball, or a molded core or center for a three-piece or thread wound golf ball. One or more additional core layers may also be disposed about the core component followed by one or more cover layers. Additionally, one or more intermediate layers may also be present.

In accordance with this development, the molded component, such as a molded core, comprises a polybutadiene composition containing at least one curing agent and one or more non-conjugated diene monomers having two or more vinyl ($CH_2$═CH—) terminal end groups. The non-conjugated diene monomers contain from about 5 to about 20 carbon groups, including from about 5 to about 12 carbon groups and from about 8 to about 10 carbon groups. It has been found that the addition of the non-conjugated diene monomers enhances the combination of certain properties of the resulting molded product.

A further advantage provided by the cured cores is that such cores are relatively soft, i.e. having a relatively low compression, yet exhibit high resilience, i.e. display drop rebounds higher than those corresponding to rebounds associated with conventional cores.

It is preferred that the base elastomer included in the composition is a polybutadiene material. Polybutadiene has been found to be particularly useful because it imparts to the golf balls a relatively high coefficient of restitution. Polybutadiene can be cured using a free radical initiator such as a peroxide. A broad range for the weight average molecular weight of preferred base elastomers is from about 50,000 to about 1,000,000. A more preferred range for the molecular weight of the base elastomer is from about 50,000 to about 500,000. As a base elastomer for the core composition, high cis-1-4-polybutadiene is preferably employed, or a blend of high cis-1-4-polybutadiene with other elastomers may also be utilized. Most preferably, high cis-1-4-polybutadiene having a weight-average molecular weight of from about 100,000 to about 500,000 is employed.

One preferred polybutadiene for use in the core assemblies of the present development feature a cis-1,4 content of at least 90% and preferably greater than 96% such as Cariflex® BR-1220 currently available from Dow Chemical, France; and Taktene® 220 currently available from Bayer, Orange, Tex.

For example, Cariflex® BR-1220 polybutadiene and Taktene® 220 polybutadiene may be utilized alone, in combination with one another, or in combination with other polybutadienes. Generally, these other polybutadienes have Mooney viscosities in the range of about 25 to 65 or higher. The general properties of BR-1220 and Taktene® 220 are set forth below.

A. Properties of Cariflex® BR-1 220 Polybutadiene

Physical Properties:

Polybutadiene Rubber

CIS 1,4 Content—97%-99% Min.

Stabilizer Type—Non Staining

Total Ash—0.5% Max.

Specific Gravity—0.90–0.92

Color—Transparent, clear, Lt. Amber

Moisture—0.3% max. ASTM® 1416.76 Hot Mill Method

Polymer Mooney Viscosity—(35–45 Cariflex®) (ML1+4 @ 212° F.)

90% Cure—10.0–13.0

Polydispersity 2.5–3.5

| Molecular Weight Data: | Trial 1 | Trial 2 |
|---|---|---|
| $M_n$ | 80,000 | 73,000 |
| $M_w$ | 220,000 | 220,000 |
| $M_z$ | 550,000 | |
| $M_{peak}$ | 110,000 | |

B. Properties of Taktene® 220 Polybutadiene

Physical Properties:

Polybutadiene Rubber

CIS 1,4 Content (%)—98% Typical

Stabilizer Type—Non Staining 1.0–1.3%

Total Ash—0.25 Max.

Raw Polymer Mooney Visc.—35–45 40 Typical (ML1+4'@212 Deg. F./212° F.)

Specific Gravity—0.91

Color—Transparent—almost colorless (15 APHA Max.)

Moisture %—0.30% Max. ASTM® 1416-76 Hot Mill Method

Product A relatively low to mid Mooney viscosity, non-staining, solution

Description polymerized, high cis-1,4-polybutadiene rubber.

| Raw Polymer Properties | | |
|---|---|---|
| Property | Range | Test Method |
| Mooney viscosity | | |
| 1 + 4(212° F.) | 40 ± 5 | ASTM ® D 1646 |
| Volatile matter (wt %) | 0.3 max. | ASTM ® D 1416 |
| Total Ash (wt %) | 0.25 max. | ASTM ® D 1416 |
| Cure(1)(2) Characteristics | | |
| Minimum torque | | |
| $M_L$ (dN · m) | 9.7 ± 2.2 | ASTM ® D 2084 |
| (lbf) · in) | 8.6 ± 1.9 | ASTM ® D 2084 |
| Maximum torque | | |
| $M_H$ (dN · m) | 35.7 ± 4.8 | ASTM ® D 2084 |
| (lbf · in) | 31.6 ± 4.2 | ASTM ® D 2084 |
| $t_2$1 (min) | 4 ± 1.1 | ASTM ® D 2084 |
| t'50 (min) | 9.6 ± 2.5 | ASTM ® D 2084 |
| t'90 (min) | 12.9 ± 3.1 | ASTM ® D 2084 |

| Other Product Features | |
|---|---|
| Property | Typical Value |
| Specific gravity | 0.91 |
| Stabilizer type | Non-staining |

(1)Monsanto Rheometer at 160° C., 1.7 Hz (100 cpm), 1 degree arc, micro-die (2)Cure characteristics determined on ASTM ® D 3189 MIM mixed compound:

| | |
|---|---|
| TAKTENE ® 220 | 100 (parts by mass) |
| Zinc oxide | 3 |
| Stearic acid | 2 |
| IRB #6 black (N330) | 60 |
| Naphthenic oil | 15 |
| TBBS | 0.9 |
| Sulfur | 1.5 |

*This specification refers to product manufactured by Bayer Corp., Orange, Texas, U.S.A.

An example of a high Mooney viscosity polybutadiene suitable for use with the present development includes Cariflex® BCP 820, from Shell Chimie of France. Although this polybutadiene produces cores exhibiting higher C.O.R. values, it is somewhat difficult to process using conventional equipment. The properties and characteristics of this preferred polybutadiene are set forth below.

Properties of Shell Chimie BCP 820 (Also Known As BR-1202J)

| Property | Value |
|---|---|
| Mooney Viscosity (approximate) | 70–83 |
| Volatiles Content | 0.5% maximum |
| Ash Content | 0.1% maximum |
| Cis 1,4-polybutadiene Content | 95.0% minimum |
| Stabilizer Content | 0.2 to 0.3% |
| Polydispersity | 2.4–3.1 |

| Molecular Weight Data: | Trial 1 | Trial 2 |
|---|---|---|
| $M_n$ | 110,000 | 111,000 |
| $M_w$ | 300,000 | 304,000 |
| $M_z$ | 680,000 | |
| $M_{peak}$ | 175,000 | |

Examples of further polybutadienes include those obtained by using a neodymium-based catalyst, such as Neo Cis 40 and Neo Cis 60 from Enichem, Polimeri Europa America, 200 West Loop South, Suite 2010, Houston, Tex. 77027, and those obtained by using a neodymium based catalyst, such as CB-22, CB-23, and CB-24 from Bayer Co., Pittsburgh, Pa. The properties of these polybutadienes are given below.

A. Properties of Neo Cis 40 and 60

Properties of Raw Polymer

| Microstructure | |
|---|---|
| 1,4 cis (typical) | 97.5% |
| 1,4 trans (typical) | 1.7% |
| Vinyl (typical) | 0.8% |
| Volatile Matter (max) | 0.75% |
| Ash (max) | 0.30% |
| Stabilizer (typical) | 0.50% |
| Mooney Viscosity, ML 1 + 4 at 100° C. | 38–48 and 60–66 |

Properties of Compound (Typical)

| Vulcanization at 145° C. | |
|---|---|
| Tensile strength, 35' cure, | 16 MPa |
| Elongation, 35' cure, | 440% |
| 300% modulus, 35' cure, | 9.5 MPa |

B. Properties of CB-22

| TESTS | RESULTS | SPECIFICATIONS |
|---|---|---|
| 1. Mooney-Viscosity | | |
| ML1 + 4 100 Cel/ | | |
| ASTM ®-sheet | | |
| ML1 + 1 Minimum | 58 | MIN. 58 ME |
| Maximum | 63 | MAX. 68 ME |
| Median | 60 | 58–68 ME |

-continued

| TESTS | RESULTS | SPECIFICATIONS |
|---|---|---|
| 2. Content of ash | 0.1 | MAX. 0.5% |
| DIN 53568 | | |
| Ash | | |
| 3. Volatile matter | 0.11 | MAX. 0.5% |
| heating 3 h/105 Cel | | |
| Loss in weight | | |
| 4. Organic acid | 0.33 | MAX. 1.0% |
| Bayer Nr.18 | | |
| Acid | | |
| 5. CIS-1,4 content | 97.62 | MIN. 96.0% |
| IR-spectroscopy | | |
| CIS 1,4 | | |
| 6. Vulcanization behavior | | |
| Monsanto MDR/160 | | |
| Cel | | |
| DIN 53529 | | |
| Compound after | | |
| ts01 | 3.2 | 2.5–4.1 min |
| t50 | 8.3 | 6.4–9.6 min |
| t90 | 13.2 | 9.2–14.0 min |
| s'min | 4.2 | 3.4–4.4 dN · m |
| s'max | 21.5 | 17.5–21.5 dN · m |
| 7. Informative data | | |
| Vulcanization 150 Cel 30 | | |
| min | | |
| Tensile | ca. 15.0 | |
| Elongation at break | ca. 450 | |
| Stress at 300% | ca. 9.5 | |
| elongation | | |

C. Properties of CB-23

| TESTS | RESULTS | SPECIFICATIONS |
|---|---|---|
| 1. Mooney-Viscosity | | |
| ML1 + 4 100 Cel/ | | |
| ASTM ®-sheet | | |
| ML1 + 4 Minimum | 50 | MIN. 46 ME |
| Maximum | 54 | MAX. 56 ME |
| Median | 51 | 46–56 ME |
| 2. Content of ash | 0.09 | MAX. 0.5% |
| DIN 53568 | | |
| Ash | | |
| 3. Volatile matter | 0.19 | MAX. 0.5% |
| DIN 53526 | | |
| Loss in weight | | |
| 4. Organic acid | 0.33 | MAX. 1.0% |
| Bayer Nr.18 | | |
| Acid | | |
| 5. CIS-1,4 content | 97.09 | MIN. 96.0% |
| IR-spectroscopy | | |
| CIS 1,4 | | |
| 6. Vulcanization behavior | | |
| Monsanto MDR/160 Cel | | |
| DIN 53529 | | |
| Compound after | MIN. 96.0 | |
| ts01 | 3.4 | 2.4–4.0 min |
| t50 | 8.7 | 5.8–9.0 min |
| t90 | 13.5 | 8.7–13.5 min |
| s'min | 3.1 | 2.7–3.8 dN · m |
| s'max | 20.9 | 17.7–21.7 dN · m |
| 7. Vulcanization test | | |
| with ring | | |
| Informative data | | |
| Tensile | ca. 15.5 | |
| Elongation at break | ca. 470 | |
| Stress at 300% | ca. 9.3 | |
| elongation | | |

D. Properties of CB-24

| TESTS | RESULTS | SPECIFICATIONS |
|---|---|---|
| 1. Mooney-Viscosity ML1 + 4 100 Cel/ ASTM ®-sheet | | |
| ML1 + 4 Minimum | 44 | MIN. 39 ME |
| Maximum | 46 | MAX. 49 ME |
| Median | 45 | 39–49 ME |
| 2. Content of ash DIN 53568 Ash | 0.12 | MAX. 0.5% |
| 3. Volatile matter DIN 53526 Loss in weight | 0.1 | MAX. 0.5% |
| 4. Organic acid Bayer Nr.18 Acid | 0.29 | MAX. 1.0% |
| 5. CIS-1,4 content IR-spectroscopy CIS 1,4 | 96.73 | MIN. 96.0% |
| 6. Vulcanization behavior Monsanto MDR/160 Cel DIN 53529 Compound after masticator | | |
| ts01 | 3.4 | 2.6–4.2 min |
| t50 | 8.0 | 6.2–9.4 min |
| t90 | 12.5 | 9.6–14.4 min |
| s'min | 2.8 | 2.0–3.0 dN · m |
| s'max | 19.2 | 16.3–20.3 dN · m |
| 7. Informative data Vulcanization 150 Cel 30 min | | |
| Tensile | ca 15.0 | |
| Elongation at break | ca. 470 | |

-continued

| TESTS | RESULTS | SPECIFICATIONS |
|---|---|---|
| Stress at 300% elongation | ca. 9.1 | |

Alternative polybutadienes include fairly high Mooney viscosity polybutadienes including the commercially available BUNA® CB series polybutadiene rubbers manufactured by the Bayer Co., Pittsburgh, Pa. The BUNA® CB series polybutadiene rubbers are generally of a relatively high purity and light color. The low gel content of the BUNA® CB series polybutadiene rubbers ensures almost complete solubility in styrene. The BUNA® CB series polybutadiene rubbers have a relatively high cis-1,4 content. Preferably, each BUNA® CB series polybutadiene rubber has a cis-1,4 content of at least 96%. Additionally, each BUNA® CB series polybutadiene rubber exhibits a different solution viscosity, preferably from about 42 mPa·s to about 170 mPa·s, while maintaining a relatively constant solid Mooney viscosity value range, preferably of from about 38 to about 52. The BUNA® CB series polybutadiene rubbers preferably have a vinyl content of less than about 12%, more preferably a vinyl content of about 2%. In this regard, below is a listing of commercially available BUNA® CB series polybutadiene rubbers and the solution viscosity and Mooney viscosity of each BUNA® CB series polybutadiene rubber.

Solution Viscosity and Mooney Viscosity of BUNA® CB Series Polybutadiene Rubbers

| Property | BUNA ® CB 1405 | BUNA ® CB 1406 | BUNA ® CB 1407 | BUNA ® CB 1409 | BUNA ® CB 1410 |
|---|---|---|---|---|---|
| Solution Viscosity mPa · s | 50 +/− 7 | 60 +/− 7 | 70 +/− 10 | 90 +/− 10 | 100 +/− 10 |
| Mooney Viscosity mL 1 + 4 100° C. | 45 +/− 5 | 45 +/− 5 | 45 +/− 5 | 45 +/− 5 | 45 +/− 5 |

| Property | BUNA ® CB 1412 | BUNA ® CB 1414 | BUNA ® CB 1415 | BUNA ® CB 1416 | BUNA ® CB 10 |
|---|---|---|---|---|---|
| Solution Viscosity mPa · s | 120 +/− 10 | 140 +/− 10 | 150 +/− 10 | 160 +/− 10 | 140 +/− 20 |
| Mooney Viscosity mL 1 + 4 100° C. | 45 +/− 5 | 45 +/− 5 | 45 +/− 5 | 45 +/− 5 | 47 +/− 5 |

Properties

| Property | Test Method | Units | BUNA ® CB 1406 | BUNA ® CB 1407 | BUNA ® CB 1409 | BUNA ® CB 1410 |
|---|---|---|---|---|---|---|
| Catalyst | | | Cobalt | Cobalt | Cobalt | Cobalt |
| Cis-1,4 | IR | % | ≧96 | ≧96 | ≧96 | ≧96 |

-continued

| | | | | | | |
|---|---|---|---|---|---|---|
| Content | Spectroscopy; AN-SAA 0422 | | | | | |
| Volatile Matter | ISO 248/ ASTM D 1416 | % | ≦0.5 | ≦0.5 | ≦0.5 | ≦0.5 |
| Ash Content | ISO 247/ ASTM D 1416 | % | ≦0.1 | ≦0.1 | ≦0.1 | ≦0.1 |
| Mooney Viscosity ML (1 + 4) 100° C. | ISO 289/DIN 53 523/ASTM D 1646 | MU | 45 ± 5 | 45 ± 5 | 45 ± 5 | 45 ± 5 |
| Solution Viscosity, 5% in styrene | ASTM D 445/ DIN 51 562 | mPa · s | 60 ± 7 | 70 ± 7 | 90 ± 10 | 100 ± 10 |
| Styrene insoluble: dry gel | 08-02.08.CB | ppm | ≦100 | ≦100 | ≦100 | ≦100 |
| Color in styrene | ISO 6271/ ASTM D 1209 | APHA | ≦10 | ≦10 | ≦10 | ≦10 |
| Solubility | | | in aliphatic hydro-carbons | in aliphatic hydro-carbons | in aliphatic hydro-carbons | in aliphatic hydro-carbons |
| Total Amount of Stabilizer | AN-SAA 0583 | % | 0.2 | 0.2 | 0.2 | 0.2 |

| Property | Test Method | Units | BUNA ® CB 1412 | BUNA ® CB 1414 | BUNA ® CB 1415 | BUNA ® CB 1416 |
|---|---|---|---|---|---|---|
| Catalyst | | | Cobalt | Cobalt | Cobalt | Cobalt |
| Cis-1,4 Content | IR Spectroscopy; AN-SAA 0422 | % | ≧96 | ≧96 | ≧96 | ≧96 |
| Volatile Matter | ISO 248/ ASTM D 1416 | % | ≦0.5 | ≦0.5 | ≦0.5 | ≦0.5 |
| Ash Content | ISO 247/ ASTM D 1416 | % | ≦0.1 | ≦0.1 | ≦0.1 | ≦0.1 |
| Mooney Viscosity ML (1 + 4) 100° C. | ISO 289/DIN 53 523/ASTM D 1646 | MU | 45 ± 5 | 45 ± 5 | 45 ± 5 | 45 ± 5 |
| Solution Viscosity, 5% in styrene | ASTM D 445/ DIN 51 562 | mPa · s | 120 ± 10 | 140 ± 10 | 150 ± 10 | 160 ± 10 |
| Styrene insoluble: dry gel | 08-02.08.CB | ppm | ≦100 | ≦100 | ≦100 | ≦100 |
| Color in styrene | ISO 6271/ ASTM D 1209 | APHA | ≦10 | ≦10 | ≦10 | ≦10 |
| Solubility | | | in aliphatic hydro-carbons | in aliphatic hydro-carbons | in aliphatic hydro-carbons | in aliphatic hydro-carbons |
| Total Amount of Stabilizer | AN-SAA 0583 | % | 0.2 | 0.2 | 0.2 | 0.2 |

In addition to the polybutadiene rubbers noted above, BUNA® CB 10 polybutadiene rubber is also very desirous to be included in the composition of the present development. BUNA® CB 10 polybutadiene rubber has a relatively high cis-1,4 content, good resistance to reversion, abrasion and flex cracking, good low temperature flexibility and high resilience. The BUNA® CB 10 polybutadiene rubber preferably has a vinyl content of less than about 12%, more preferably about 2% or less. Listed below is a brief description of the properties of the BUNA@ CB 10 polybutadiene rubber.

Properties of BUNA® CB 10 Polybutadiene Rubber

| | Value | Unit | Test method |
|---|---|---|---|
| Raw Material Properties | | | |
| Volatile Matter | ≦0.5 | wt-% | ISO 248/ASTM D 5668 |
| Mooney viscosity ML(1 + 4) @ 100° C. | 47 ± 5 | MU | ISO 289/ASTM D 1646 |
| Solution viscosity, 5.43 wt % in toluene | 140 ± 20 | mPa · s | ASTM D 445/ISO 3105 (5% in toluene) |

-continued

| | Value | Unit | Test method |
|---|---|---|---|
| Cis-1,4 content | ≧96 | wt-% | IR Spectroscopy, AN-SAA 0422 |
| Color, Yellowness Index | ≦10 | | ASTM E 313-98 |
| Cobalt content | ≦5 | ppm | DIN 38 406 E22 |
| Total Stabilizer content | ≧0.15 | wt-% | AN-SAA 0583 |
| Specific Gravity | 0.91 | | |
| Monsanto Rheometer MDR 2000E, 160° C./30 min./α = ±0.5° C. | | | |
| Vulcanization Properties (Test formulation from ISO 2476/ ASTM D 3189 (based on IRB 7)) | | | |
| Torque Minimum (ML) | 3.5 ± 0.7 | dNm | ISO 6502/ASTM D5289 |
| Torque Maximum (MH) | 19.9 ± 2.4 | dNm | ISO 6502/ASTM D5289 |
| Scorch Time, $t.s._1$ | 2.9 ± 0.6 | min | ISO 6502/ASTM D5289 |
| Cure Time, $t.c._{50}$ | 8.7 ± 1.7 | min | ISO 6502/ASTM D5289 |
| Cure Time, $t.c._{90}$ | 12.8 ± 2.4 | min | ISO 6502/ASTM D5289 |

The base elastomer utilized in the present development can also be mixed with other elastomers. These include natural rubbers, polyisoprene rubber, SBR rubber (styrene-butadiene rubber) and others to produce certain desired core properties.

Also included with the base elastomer is one or more non-conjugated diene monomers having two or more vinyl ($CH_2$═CH—) terminal end groups. The non-conjugated diene monomers contain from about 5 to about 20 carbon groups, including from about 5 to about 12 carbon groups and from about 8 to about 10 carbon groups. The diene monomers include both linear and non-linear non-conjugated monomers.

Examples of such a non-conjugated diene monomers are 1,7-Octadiene and 1,9-Decadiene. Characteristics of these compositions are set forth below:

A. 1,7-Octadiene

Molecular Structure 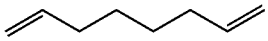

CAS No. [3710-30-3]
$C_8H_{14}$
$H_2C$═$CH(CH_2)_4CH$—$CH_2$
F.W. 110.2 g/mol.
Density 0.74
Melting Point −70
Boiling Point 114–121
Flash Point 9
Refractive Index 1.421–1.423

B. 1.9-Decadiene

Molecular Structure 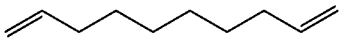

CAS No. [1647-16-1]
$C_{10}H_{18}$
$H_2C$═$CH(CH_2)_6CH$—$CH_2$
F.W. 138.25
Density 0.75
Boiling Point 169
Flash Point 41
Refractive Index 1.432–1.434

These compositions are commercially available from Degussa Corporation, Parsippany, N.J.; Fisher Scientific, Fisher Chemicals 1 Reagent Lane Fairlawn, N.J. 07410; Aldrich, 1001 West Saint Paul Avenue, Milwaukee, Wis. 53233; GFC Chemical Inc., Powell, Ohio; and other chemical sources.

An example of a non-linear, non-conjugated diene monomer suitable for use herein includes 1,2,4-Trivinyl cyclohexane. Some of the properties of this composition are as follows:

Name: 1,2,4-Trivinyl cyclohexane
Cas-Name: Cyclohexane,1,2,4-triethenyl-
Cas-No.: 2855-27-8
Formula: $C_{12}H_{18}$ Structure: 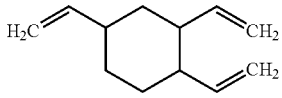

This composition is also available at Degussa and Aldrich amongst other chemical suppliers.

Additional non-conjugated diene monomers suitable for use herein include, but are not limited to divinyl glycol ($C_6H_{10}O_2$) and dicyclopentadiene ($C_{10}H_{12}$).

The non-conjugated diene monomers are included in the core compositions in amounts of from about 0.1 to about 6.0 parts by weight per each 100 parts of elastomer, including from about 0.5 to about 4.0 and from about 1.0 to about 3.0 parts by weight per each 100 parts of elastomer.

The curing agent of the elastomeric composition of the present development is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and calcium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 15 to about 50, and preferably from about 17 to about 35 parts by weight of the carboxylic acid salt, such as zinc diacrylate (ZDA), is included per 100 parts of the elastomer components in the core composition. The unsaturated carboxylic acids and metal salts thereof are generally soluble in the elastomeric base, or are readily dispersible. Examples of such commercially available curing agents include the zinc acrylates and zinc diacrylates available from Sartomer Company, Inc., 502 Thomas Jones Way, Exton, Pa.

The free radical initiator included in the elastomeric composition of the present development is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present development, generally in amounts of from about 0.1 to about 10.0 and preferably in amounts of from about 0.3 to about 3.0 parts by weight per each 100 parts of elastomer, wherein the peroxide has a 40% level of active peroxide.

Exemplary of suitable peroxides for the purposes of the present development are dicumyl peroxide, n-butyl 4,4'-bis (butylperoxy)valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercial available peroxides are Luperco™ 230 or 231 XL, a peroxyketal manufactured and sold by Atochem, Lucidol Division, Buffalo, N.Y., and Trigonox™ 17/40 or 29/40, a peroxyketal manufactured and sold by Akzo Chemie America, Chicago, Ill. The one hour half life of Luperco™ 231 XL and Trigonox™ 29/40 is about 112° C., and the one hour half life of Luperco™ 230 XL and Trigonox™ 17/40 is about 129° C. Luperco™ 230 XL and Trigonox™ 17/40 are n-butyl-4,4-bis(t-butylperoxy) valerate and Luperco™ 231 XL and Trigonox™ 29/40 are 1,1-di(t-butylperoxy) 3,3,5-trimethyl cyclohexane.

More preferably, Trigonox™ 42-40B from Akzo Nobel of Chicago, Ill. is used in the present development. Most preferably, a solid form of this peroxide is used. Trigonox™ 42-40B is tert-Butyl peroxy-3,5,5-trimethylhexanoate. The liquid form of this agent is available from Akzo under the designation Trigonox™ 42S.

Preferred co-agents which can be used with the above peroxide polymerization agents include zinc diacrylate (ZDA), zinc dimethacrylate (ZDMA), trimethylol propane triacrylate, and trimethylol propane trimethacrylate, most preferably zinc diacrylate. Other co-agents may also be employed and are known in the art.

The elastomeric polybutadiene compositions of the present development can also optionally include one or more halogenated organic sulfur compounds. Preferably, the halogenated organic sulfur compound is a halogenated thiophenol of the formula below:

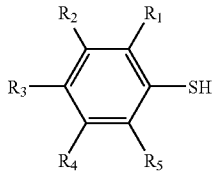

wherein $R_1$–$R_5$ can be halogen groups, hydrogen, alkyl groups, thiol groups or carboxylated groups. At least one halogen group is included, preferably 3–5 of the same halogenated groups are included, and most preferably 5 of the same halogenated groups are part of the component. Examples of such fluoro-, chloro-, bromo-, and iodothiophenols include, but are not limited to pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol; 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophehol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol; and their metal salts thereof, and mixtures thereof. The metal salt may be salts of zinc, calcium, potassium, magnesium, sodium, and lithium.

Pentachlorothiophenol or a metallic salt of pentachlorothiophenol is preferably included in the present development. For example, RD 1302 of Rheim Chemie of Trenton, N.J. can be included therein. RD 1302 is a 75% masterbatch of Zn PCTP in a high-cis polybutadiene rubber.

Other suitable pentachlorothiphenols include those available from Dannier Chemical, Inc., Tustin, Calif., under the designation Dansof P™. The product specifications of Dansof P™ are set forth below:

| | |
|---|---|
| Compound Name | Pentachlorothiophenol |
| Synonym | (PCTP) |
| CAS # | n/a |
| Molecular Formula: | C6CI5SH |
| Molecular Weight: | 282.4 |
| Grade: | Dansof P |
| Purity: | 97.0% (by HLPC) |
| Physical State: | Free Flowing Powder |
| Appearance | Light Yellow to Gray |
| Moisture Content (K.F.) | <0.4% |
| Loss on Drying (% by Wt.): | <0.4% |
| Particle Size: | 80 mesh |

The molecular structure of pentachlorothiophenol is represented below:

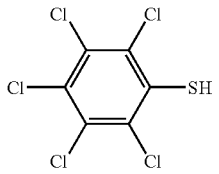

A representative metallic salt of pentachlorothiophenol is the zinc salt of pentachlorothiophenol (ZnPCTP) sold by Dannier Chemical, Inc. under the designation Dansof Z™. The properties of this material are as follows:

| | |
|---|---|
| Compound Name | Zinc Salt of Pentachlorothiophenol |
| Synonym | Zn(PCTP) |
| CAS # | n/a |
| Molecular Formula: | |
| Molecular Weight: | |
| Grade: | DR 14 |
| Purity: | ≥99.0% |
| Physical State: | Free Flowing Powder |
| Appearance | Off-white/Gray |
| Odor: | Odorless |
| Moisture Content (K.F.) | <0.5% |
| Loss on Drying (% by Wt.): | <0.5% |
| Mesh Size: | 100 |
| Specific Gravity | 2.33 |

Pentachlorothiophenol or a metallic salt thereof is added to the core material in an amount of 0.01 to 5.0 parts by weight, preferably 0.1 to 2.0 parts by weight, more preferably 0.5 to 1.0 parts by weight, on the basis of 100 parts by weight of the base elastomer.

In addition to the foregoing, filler materials can be employed in the compositions of the development to control the weight and density of the ball. Fillers which are incorporated into the compositions should be in finely divided form, typically in a size generally less than about 20 mesh, preferably less than about 100 mesh U.S. standard size. Preferably, the filler is one with a specific gravity of from about 0.5 to about 19.0. Examples of fillers which may be employed include, for example, silica, clay, talc, mica, asbestos, glass, glass fibers, barytes (barium sulfate), limestone, lithophone (zinc sulphide-barium sulfate), zinc oxide, titanium dioxide, zinc sulphide, calcium metasilicate, silicon carbide, diatomaceous earth, particulate carbonaceous materials, micro balloons, aramid fibers, particulate synthetic plastics such as high molecular weight polyethylene, polystyrene, polyethylene, polypropylene, ionomer resins and the like, as well as cotton flock, cellulose flock and leather fiber. Powdered metals such as titanium, tungsten, aluminum, bismuth, nickel, molybdenum, copper, brass and their alloys also may be used as fillers.

The amount of filler employed is primarily a function of weight restrictions on the weight of a golf ball made from those compositions. In this regard, the amount and type of filler will be determined by the characteristics of the golf ball desired and the amount and weight of the other ingredients in the core composition. The overall objective is to closely approach the maximum golf ball weight of 1.620 ounces (45.92 grams) set forth by the U.S.G.A.

The compositions of the development also may include various processing aids known in the rubber and molding arts, such as fatty acids. Generally, free fatty acids having from about 10 carbon atoms to about 40 carbon atoms, preferably having from about 15 carbon atoms to about 20 carbon atoms, may be used. Fatty acids which may be used include stearic acid and linoleic acids, as well as mixtures thereof. When included in the compositions of the development, the fatty acid component is present in amounts of from about 1 part by weight per 100 parts elastomer, preferably in amounts of from about 2 parts by weight per 100 parts elastomer to about 5 parts by weight per 100 parts elastomer. Examples of processing aids which may be employed include, for example, calcium stearate, barium stearate, zinc stearate, lead stearate, basic lead stearate, dibasic lead phosphite, dibutyltin dilaurate, dibutyltin dimealeate, dibutyltin mercaptide, as well as dioctyltin and stannane diol derivatives.

Coloring pigments also may be included in the compositions of the development. Useful coloring pigments include, for example, titanium dioxide, the presence of which simplifies the surface painting operation of a one piece golf ball. In some cases, coloring pigments eliminate the need for painting such as, for example, a one piece golf ball intended for use on driving ranges.

The core compositions of the present development may additionally contain any other suitable and compatible modifying ingredients including, but not limited to, metal oxides, fatty acids, and diisocyanates and polypropylene powder resin.

Various activators may also be included in the compositions of the present development. For example, zinc oxide and/or magnesium oxide are activators for the polybutadiene. The activator can range from about 2 to about 50 parts by weight per 100 parts by weight of the rubbers (phr) component, preferably at least 3 to 5 parts by weight per 100 parts by weight of the rubbers.

Higher specific gravity fillers may be added to the core composition so long as the specific core weight limitations are met. The amount of additional filler included in the core composition is primarily dictated by weight restrictions and preferably is included in amounts of from about 0 to about 100 parts by weight per 100 parts rubber. Ground flash filler may be incorporated and is preferably mesh ground up center stock from the excess flash from compression molding. It lowers the cost and may increase the hardness of the ball.

Diisocyanates may also be optionally included in the core compositions. When utilized, the diisocyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present development. The specific types and amounts of such additives are set forth in the above identified patents, which are incorporated herein by reference.

A golf ball or a molded component thereof formed from compositions of the development may be made by conventional mixing and compounding procedures used in the rubber industry. For example, the ingredients may be intimately mixed using, for example, two roll mills or a BANBURY® mixer, until the composition is uniform, usually over a period of from about 5 to 20 minutes. The sequence of addition of components is not critical. A preferred blending sequences is as follows.

The elastomer, sodium hexamethylene thiosulfate (DHTS), the halogenated thiophenol (if desired), fillers, zinc salt, metal oxide, fatty acid, and the metallic dithiocarbamate (if desired), surfactant (if desired), and tin difatty acid (if desired), are blended for about 7 minutes in an internal mixer such as a BANBURY® mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out. The mixing is desirably conducted in such a manner that the composition does not reach incipient polymerization temperature during the blending of the various components.

The composition can be formed into a core structure by any one of a variety of molding techniques, e.g. injection, compression, or transfer molding. If the core is compression molded, the sheet is then rolled into a "pig" and then placed in a BARWELL® preformer and slugs are produced. The slugs are then subjected to compression molding at about 320° F. for about 14 minutes. After molding, the molded cores are cooled at room temperature for about 4 hours or in cold water for about one hour.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. When the composition is cured by heating, the time required for heating will normally be short, generally from about 10 to about 20 minutes, depending upon the particular curing agent used. Those of ordinary skill in the art relating to free radical curing agents for polymers are conversant with adjustments to cure times and temperatures required to effect optimum results with any specific free radical agent.

After molding, the core is removed from the mold and the surface may be treated to facilitate adhesion thereof to the covering materials. Surface treatment can be effected by any of the several techniques known in the art, such as corona discharge, ozone treatment, sand blasting, and the like. Preferably, surface treatment is effected by grinding with an abrasive wheel (centerless grinding) whereby a thin layer of the molded core is removed to produce a round core having a diameter of 1.28 to 1.63 inches, preferably about 1.37 to about 1.600 inches, and most preferably, 1.585 inches. Alternatively, the cores are used in the as-molded state with no surface treatment.

One or more cover layers can be applied about the present core in accordance with procedures known in the art. The composition of the cover may vary depending upon the desired properties for the resulting golf ball. Any known cover composition to form a cover can be used. U.S. Pat. Nos. 6,290,614; 6,277,921; 6,220,972; 6,150,470; 6,126,559; 6,117,025; 6,100,336; 5,779,562; 5,688,869; 5,591,803; 5,542,677; 5,368,304, 5,312,857, and 5,306,760 herein entirely incorporated by reference, disclose cover compositions, layers, and properties suitable for forming golf balls in accordance with the present development.

In a multi-layer golf ball, the core is converted into a golf ball by providing at least one layer of covering material thereon. The thickness of the cover layer(s) is dependent upon the overall ball size desired. However, typical ranges in cover thicknesses are from about 0.005 to about 0.250 inches, preferably from about 0.010 to about 0.090 inches, and more preferably from about 0.015 to about 0.040 inches.

In this regard, the present development can be used in forming golf balls of a wide variety of sizes. The U.S.G.A. dictates that the size of a competition golf ball must be at least 1.680 inches in diameter, however, golf balls of any size can be used for leisure golf play.

Furthermore, the preferred diameter of the golf balls is from about 1.680 inches to about 1.800 inches. The more preferred diameter is from about 1.680 to about 1.780 inches. A diameter of from about 1.680 to about 1.760 inches is most preferred. Oversize golf balls with diameters above 1.700 inches are also within the scope of this development.

The cover or the layers of the multi-layer cover may be formed from generally the same resin composition, or may be formed from the different resin compositions with similar hardnesses. For example, one cover layer may be formed from an ionomeric resin of ethylene and methacrylic acid, while another layer is formed from an ionomer of ethylene and acrylic acid. One or more cover layers may contain polyamides or polyamide-nylon copolymers or intimate blends thereof. Furthermore, polyurethanes, Pebax® polyetheramides, Hytrel® polyesters, natural or synthetic balatas, and/or thermosetting polyurethanes/polyureas can be used. Preferably, the cover composition is an ionomer blend, a polyurethane/polyurea or blends thereof. In order to visibly distinguish the layers, various colorants, metallic flakes, phosphorous, florescent dyes, florescent pigments, etc., can be incorporated in the resin.

The covered golf ball can be formed in any one of several methods known in the art. For example, the molded core may be placed in the center of a golf ball mold and the ionomeric resin-containing cover composition injected into and retained in the space for a period of time at a mold temperature of from about 40° F. to about 120° F.

Alternatively, the cover composition may be injection molded at about 300° F. to about 450° F. into smooth-surfaced hemispherical shells, a core and two such shells placed in a dimpled golf ball mold and unified at temperatures on the order of from about 200° F. to about 300° F.

The golf ball produced is then painted and marked, painting being effected by spraying techniques.

The present development is further illustrated by the following examples in which the parts of the specific ingredients are by weight. It is to be understood that the present development is not limited to the examples, and various changes and modifications may be made in the development without departing from the spirit and scope thereof.

EXAMPLE 1

Several spherical core components were produced utilizing the formulations set forth below (all amounts are parts by weight unless otherwise indicated):

| Ingredients (grams) | Control A | B | C | D | E | F |
|---|---|---|---|---|---|---|
| Core Masterblend[1] | 165.65 | 165.65 | 165.65 | 165.65 | 165.65 | 165.65 |
| Dansof Z[2] | — | 0.5 | — | — | — | — |

-continued

| Ingredients (grams) | Control A | B | C | D | E | F |
|---|---|---|---|---|---|---|
| RD 1302 Zn PCTP MB[3] | — | — | 0.66 | — | — | — |
| Duralink DHTS[4] | — | — | — | 1 | — | — |
| Trivinyl cyclohexane | — | — | — | — | 1 | — |
| 1,7-Octadiene | — | — | — | — | — | 1 |
| Size | 1.579 | 1.58 | 1.578 | 1.576 | 1.577 | 1.575 |
| Weight | 38.74 | 38.8 | 38.7 | 38.8 | 38.6 | 38.6 |
| I Comp | 0.0913 | 0.1030 | 0.1045 | 0.0899 | 0.0922 | 0.0930 |
| COR | 0.8059 | 0.8052 | 0.8050 | 0.8074 | 0.8066 | 0.8072 |
| Nes factor[5] | 897.2 | 908.2 | 909.5 | 897.3 | 898.8 | 900.2 |
| | Nes Diff | 11 | 12.3 | 0.1 | 1.6 | 3 |

| | | |
|---|---|---|
| [1]Masterblend: | CB 10 | 70 |
| | NeoCis 60 | 30 |
| | Zn Oxide | 19.4 |
| | Zn Stearate | 16 |
| | ZDA | 29 |
| | Trig 42/40 | 1.25 |
| | | 165.65 |

[2]Dansof Z is a zinc salt of pentachlorothiophenol (Zn PCTP) available from Dannier Chemical, Inc., Tustin, CA.
[3]RD 1302 is Zn PCTP masterbatch from Rhein Chemie, Trenton, NJ. It is a 75% masterbatch of Zn PCTP in a high-cis polybutadiene rubber.
[4]Duralink DHTS is 1,6-bis(thiosulfate), disodium salt, dihydrate available from Flexsys America, Akron, Ohio.
[5]Nes factor is determined by taking the sum of the Instrom compression and resilience (C.O.R.) measurements and multiplying this value by 1000. It represents an optimal combination of softer but more resilient cores.

The results indicated that the addition of the 1,7-Octadiene to a high solution viscosity/high linearity polybutadiene material (i.e., CB 10, etc.) produced a softer, more resilient core. See, for example, Formulation 1F in comparison to Formulation 1A (Control) wherein an enhanced combination of compression and resilience characteristics is produced as noted by the Nes factor parameter.

EXAMPLE 2

Several different types of polybutadienes (CB 10, Necodene 60, and Neo Cis 60) and zinc diacrylates (ZDA), as well as varying amounts of zinc stearate, etc., were added to various formulations including those containing 1,7-Octadiene. The results of these formulations are presented below:

| | A | | B | | C | | D | | E | |
|---|---|---|---|---|---|---|---|---|---|---|
| | Parts | BW | Parts | BW | Parts | BW | Parts | BW | Parts | BW |
| CB 10 | 70 | 420 | 70 | 420 | 0 | 0 | 0 | 0 | 70 | 420 |
| Neodene 60 | 0 | 0 | 0 | 0 | 100 | 600 | 100 | 600 | 0 | 0 |
| Neo Cis 60 | 30 | 180 | 30 | 180 | 0 | 0 | 0 | 0 | 30 | 180 |
| Zinc Oxide | 18.9 | 113.4 | 17.5 | 105 | 17.5 | 105 | 16.5 | 99 | 18.9 | 113.4 |
| Zinc Stearate | 16 | 96 | 16 | 96 | 16 | 96 | 3 | 18 | 16 | 96 |
| TF ZDA | 30 | 180 | 0 | 0 | 0 | 0 | 0 | 0 | 0 | 0 |
| ZDA[1] | 0 | 0 | 34 | 204 | 34 | 204 | 35 | 210 | 30 | 180 |
| Zn PCTP MB | 0.67 | 4.02 | 0.67 | 4.05 | 0.67 | 4.05 | 0.67 | 4.05 | 0.67 | 4.05 |
| Duralink DHTS | 0 | 0 | 0 | 0 | 1 | 6 | 1 | 6 | 0 | 0 |
| 1,7-Octadiene | 0 | 0 | 0 | 0 | 0 | 0 | 0 | 0 | 1 | 6 |
| Trig 42/40 | 1.25 | 7.5 | 1.25 | 7.5 | 1.25 | 7.5 | 1.25 | 7.5 | 1.25 | 7.5 |
| Color | Orange | | Purple | | Gold | | Tan | | White | |
| Size Pole | 1.505 | | 1.507 | | 1.504 | | 1.503 | | 1.507 | |
| Size EQ | 1.505 | | 1.507 | | 1.505 | | 1.503 | | 1.507 | |
| Weight | 34.16 | | 34.05 | | 34.03 | | 34.07 | | 33.93 | |
| Instron Comp | 0.1017 | | 0.1012 | | 0.1004 | | 0.0993 | | 0.1124 | |
| COR | 0.8100 | | 0.8107 | | 0.8129 | | 0.8170 | | 0.8043 | |
| Nes factor | 912 | | 912 | | 913 | | 916 | | 917 | |

[1]ZDA is SR 416, a modified ZDA, available from Sartomer.

The results indicated that the addition of 1,7-Octadiene increased the Nes factor (i.e., combination of compression and C.O.R.) of the core. See Formulation 2E in comparison to the control (i.e., 2A).

EXAMPLE 3

Varying amounts of different non-conjugated dienes were added to a Cariflex 1120/Neo Cis 60 core formulation and the following characteristics were noted.

| | A pph | B pph | C Pph | D pph | E pph | F pph | G pph |
|---|---|---|---|---|---|---|---|
| Cariflex 1220 | 65 | 65 | 65 | 65 | 65 | 65 | 65 |
| Neo Cis 60 | 35 | 35 | 35 | 35 | 35 | 35 | 35 |
| Zinc Oxide | 16 | 16 | 146 | 16 | 16 | 16 | 16 |
| Zinc Stearate | 16 | 16 | 16 | 16 | 16 | 16 | 16 |
| ZDA | 26 | 26 | 26 | 26 | 26 | 26 | 26 |
| Trig 41/40 | 1.25 | 1.25 | 1.25 | 1.25 | 1.25 | 1.25 | 1.25 |
| 1,9-Decadiene | — | 1 | 3 | — | — | — | — |
| 1,7-Octadiene | — | — | — | 1 | 3 | — | — |
| Trivinyl cyclohexane | — | — | — | — | — | 1 | 3 |
| Size | 1.512 | 1.513 | 1.516 | 1.511 | 1.509 | 1.51 | 1.51 |
| Weight | 33.6 | 33.6 | 33.5 | 33.5 | 33.5 | 33.6 | 33.4 |
| Compression | 0.103 | 0.107 | 0.112 | 0.106 | 0.112 | 0.106 | 0.115 |
| COR | 0.805 | 0.804 | 0.801 | 0.804 | 0.801 | 0.803 | 0.796 |
| Nes factor | 908 | 911 | 913 | 910 | 913 | 909 | 911 |
| Shore C/D | 79/52 | 77/51 | 75/50 | 79/53 | 76/49 | 78/51 | 74/49 |

As shown above, all of the samples containing the non-conjugated dienes produced enhanced combinations of core softness (compression) and resilience as noted by the Nes factor values. See, for example, Formulations 3B-3G in comparison to the control, i.e., Formulation 3A. Additionally, the data also indicates that as the amount of non-conjugated dienes utilized increases, enhanced Nes factor values were also produced.

The development has been described with reference to the preferred embodiments. Obviously, modifications and alterations will occur to others upon reading and understanding the preceding detailed description. It is intended that the development be construed as including all such alterations and modifications insofar as they come within the scope of the claims and the equivalents thereof.

What is claimed is:

1. A golf ball, or a component thereof, molded from a composition comprising a base elastomer selected from the group consisting of polybutadiene and mixtures of polybutadiene with other elastomers, at least one metallic salt of an unsaturated monocarboxylic acid, a free radical initiator, and a non-conjugated diene monomer.

2. The composition as defined in claim 1, wherein said non-conjugated diene monomer is selected from the group consisting of 1,7-Octadiene, 1,9-Decadiene, and 1,2,4-Trivinyl cyclohexane.

3. The composition as defined in claim 1, wherein said polybutadiene has a weight average molecular weight of from about 50,000 to about 1,000,000 and a Mooney viscosity of from about 20 to about 100.

4. The composition as defined by claim 1, further comprising a modifying ingredient selected from the group consisting of fillers, peptizers, fatty acids, metal oxides, and mixtures thereof.

5. The composition as defined in claim 1, wherein said non-conjugated diene monomer enhances the combination of resilience and compression of the golf ball or the golf ball component thereof.

6. The composition as defined in claim 2, wherein said composition comprises from about 0.5 to about 6.0 parts by weight of the non-conjugated diene monomer based on 100 parts by weight elastomer.

7. The composition as defined in claim 1, wherein said composition comprises from about 0.50 to about 4.0 parts by weight of the non-conjugated diene monomer based on 100 parts by weight elastomer.

8. The composition as defined in claim 1, wherein said composition comprises from about 1.0 to about 3.0 parts by weight of the non-conjugated diene monomer based on 100 parts by weight elastomer.

9. The composition of claim 1, wherein said non-conjugated diene monomer comprises from about 5 to about 20 carbon groups.

10. The composition of claim 1, wherein said non-conjugated diene monomer comprises from about 5 to about 12 carbon groups.

11. The composition of claim 1, wherein said non-conjugated diene monomer comprises from about 8 to about 12 carbon groups.

12. The golf ball or golf ball component produced by the composition of claim 1, wherein said composition also includes a halogenated organic sulfur compound.

13. The composition of claim 1, further comprising an organo sulfur or organo sulfur metal salt material.

14. A composition for forming a golf ball or a golf ball component, said composition comprising a base elastomer selected from polybutadiene and mixtures of polybutadiene with other elastomers, said polybutadiene having a weight average molecular weight of from about 50,000 to about 500,000, at least one metallic salt of an $\alpha$, $\beta$-ethylenically unsaturated monocarboxylic acid, a free radical initiator, and a non-conjugated diene monomer having two or more vinyl terminal end groups.

15. The composition as defined in claim 14, wherein said non-conjugated diene monomer is selected from the group consisting of 1,7-Octadiene; 1,9-Decadiene and 1,2,4-Trivinyl cyclohexane.

16. The composition as defined in claim 14, wherein said non-conjugated diene monomer is 1,7-Octadiene.

17. The composition as defined in claim 15, wherein said non-conjugated diene monomer is 1,9-Decadiene.

18. The composition as defined by claim 14, further comprising a modifying ingredient selected from fillers, fatty acids, peptizers, metal oxides, and mixtures thereof.

19. The composition as defined in claim 14, wherein said non-conjugated diene monomer enhances the compression and softness of the golf ball or molded golf ball component.

20. The composition as defined in claim 14, wherein said composition comprises from about 0.1 to about 6.0 parts by weight of the non-conjugated diene monomer based on 100 parts by weight elastomer.

21. The composition as defined in claim 14, wherein said composition comprises from about 0.10 to about 3.0 parts by weight of the non-conjugated diene monomer based on 100 parts by weight elastomer.

22. The composition as defined in claim 14, wherein said golf ball component is a golf ball center, core, mantle or cover or a layer thereof.

23. The composition of claim 14, further comprising an organo sulfur or organo sulfur metal salt material.

24. The composition of claim 23, wherein said organo sulfur is pentachlorothiophenol.

25. The composition of claim 23, wherein said organo sulfur metal salt is a zinc salt of pentachlorothiophenol.

* * * * *